US006081102A

United States Patent [19]

Hofholzer et al.

[11] Patent Number: 6,081,102

[45] Date of Patent: Jun. 27, 2000

[54] ROLLER DRIVE FOR THE FEED OF A WEB OF MATERIAL, IN PARTICULAR FOR THE WEB FEED OF A NEEDLING MACHINE

[75] Inventors: Heinz Hofholzer, Linz; Augustin Kalteis, Traun, both of Austria

[73] Assignee: Textilmaschinenfabrik Dr. Ernst Fehrer Aktiengesellschaft, Leonding, Austria

[21] Appl. No.: 09/206,062

[22] Filed: Dec. 4, 1998

[30] Foreign Application Priority Data

Dec. 12, 1997 [AT] Austria ..... 2098/97

[51] Int. Cl.[7] ..... H02P 9/04

[52] U.S. Cl. ..... 322/16; 112/113

[58] Field of Search ..... 290/1 R, 1 C, 290/4 R, 4 A; 322/16, 14; 112/121, 113

[56] References Cited

U.S. PATENT DOCUMENTS

| | | | |
|---|---|---|---|
| 3,742,879 | 7/1973 | Schaefer, Jr. et al. | 112/121.12 |
| 3,785,910 | 1/1974 | Parry | 156/580 |
| 4,203,041 | 5/1980 | Sachs | 307/67 |
| 4,373,458 | 2/1983 | Dorosz et al. | 112/121.12 |
| 4,465,002 | 8/1984 | Sahl | 112/111 |
| 4,563,960 | 1/1986 | Albrecht | 112/121.15 |
| 4,986,483 | 1/1991 | Ryu et al. | 242/45 |
| 5,010,834 | 4/1991 | Iimuro et al. | 112/302 |
| 5,689,174 | 11/1997 | Pacheco, Sr. | 322/16 |
| 5,804,948 | 9/1998 | Foust | 322/16 |

*Primary Examiner*—Nicholas Ponomarenko
*Attorney, Agent, or Firm*—Collard & Roe, PC

[57] ABSTRACT

There is described a roller drive for the feed of a web of material, in particular for the web feed of a needling machine, comprising an electric drive motor (2) for at least one feed roller (1), which is connected to a mains-operated intermediate DC circuit (5). To create advantageous constructional conditions it is proposed that the mechanical drive train between the drive motor (2) and the feed roller (1) includes an additional electric motor (9) likewise connected to the intermediate DC circuit (5), which additional motor can be driven as generator by the drive motor (2).

3 Claims, 1 Drawing Sheet

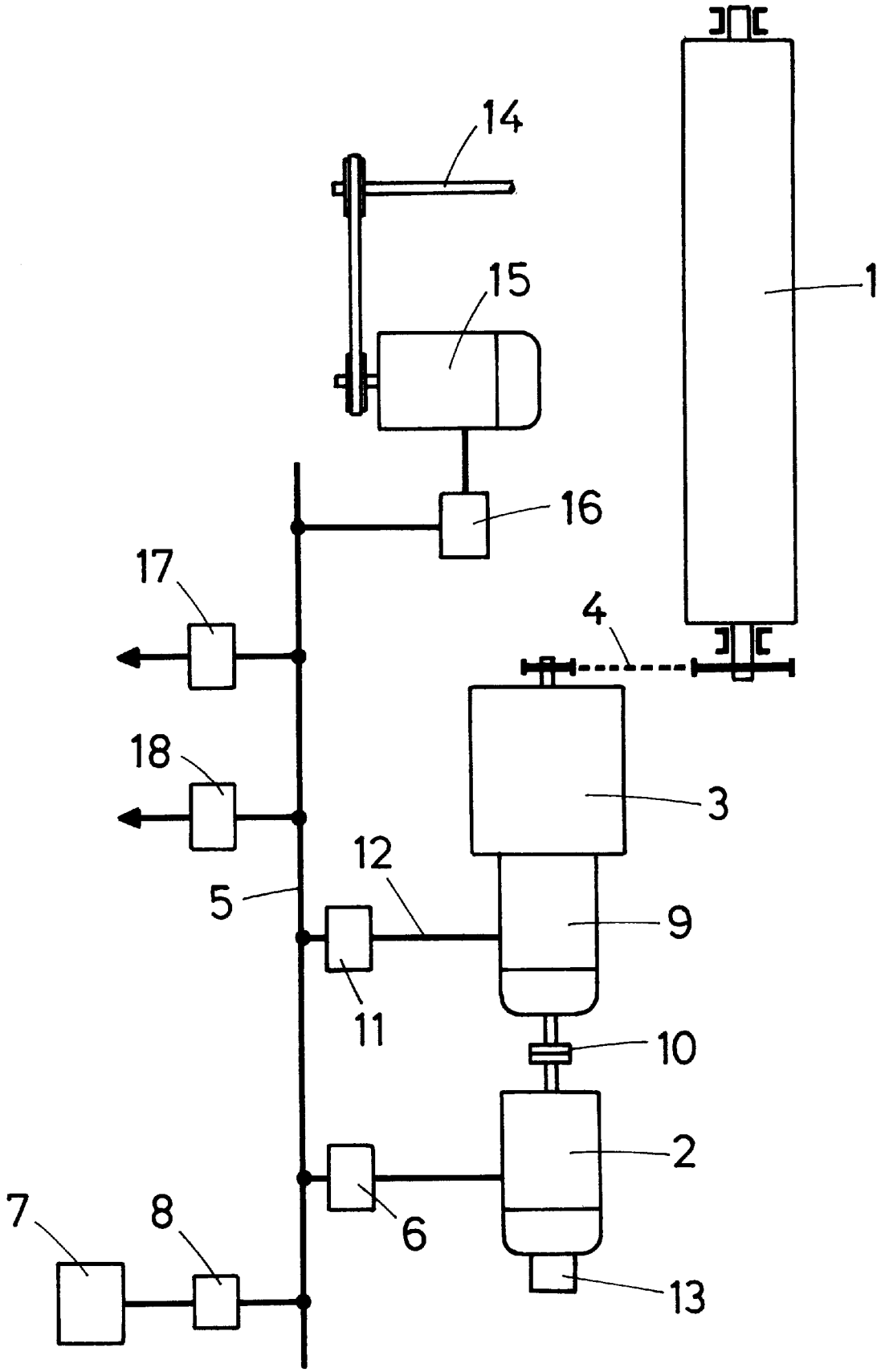
14
15
1
16
17
4
18
3
12
5
9
11
10
2
7
8
6
13

ROLLER DRIVE FOR THE FEED OF A WEB OF MATERIAL, IN PARTICULAR FOR THE WEB FEED OF A NEEDLING MACHINE

FIELD OF THE INVENTION

This invention relates to a roller drive for the feed of a web of material, in particular for the web feed of a needling machine, comprising an electric drive motor for at least one feed roller, which is connected to a mains-operated intermediate DC circuit.

DESCRIPTION OF THE PRIOR ART

In needling machines, the feed drive for the web is effected by an electric drive motor separate from the main drive for the needle bar, which involves the risk that in the case of a breakdown of the drive motor the web is destroyed by the needles repeatedly stitching into the web at the same point, until the main drive is switched off and the needling machine slows down. In this connection it should be considered that due to the inertia of the masses moved by the main drive a corresponding slowing-down time of the needling machine must be expected.

To ensure the supply of the drive motor with electric energy in the case of a mains failure, it is known to provide the drive motor with electric energy via an intermediate DC circuit, which is not only connected to the mains, but also to an additional power source, which in the case of a mains failure effects the power supply of the intermediate DC circuit. In such emergency power supply it is, however, disadvantageous that only the mains failure, but not a defect in the vicinity of the drive motor can be considered for the web feed.

When, as is likewise known, an additional drive connection is created between the main drive shaft of the needling machine and the drive shaft for the web feed, which drive connection acts on the drive shaft for the web feed via a freewheeling clutch, it is by means of this drive connection that in the case of a breakdown of the drive motor the web feed can be maintained via the main drive shaft of the needling machine, because in the case of a decrease of the rotational speed of the drive shaft for the web feed below the freewheeling speed the drive connection to the main drive shaft becomes effective, so that the web feed can be ensured both in the case of a defect of the drive motor and in the case of a mains failure during the slowing-down time of the needling machine, however at a correspondingly reduced feed rate. Such safety drive for the web feed involves, however, a considerable additional constructive effort, because the drive connection between the main drive shaft and the drive shaft for the web feed must include a variable speed transmission in addition to the freewheeling clutch.

SUMMARY OF THE INVENTION

It is therefore the object underlying the invention to design a roller drive for the feed of a web of material, in particular for the web feed of a needling machine as described above with comparatively simple constructive means such that a safety drive for the web feed can be ensured without a mechanical drive connection between the main drive shaft of the needling machine and the drive shaft for the web feed.

This object is solved by the invention in that the mechanical drive train between the drive motor and the feed roller includes an additional electric motor, which is likewise connected to the intermediate DC circuit and can be driven as generator by the drive motor.

Since the additional electric motor in the mechanical drive train between the drive motor and the feed roller can be operated as motor or as generator in dependence on its load, a corresponding choice of the nominal rotational speed of the additional motor as compared to the rotational speed of the drive motor provides for operating the additional motor via the drive motor as generator which feeds the produced electric energy into the intermediate DC circuit. In the case of a breakdown of the drive of the additional motor via the drive motor due to a defect in the vicinity of the drive motor, the additional motor automatically starts to operate in the motor mode and continues to drive the feed roller without interruption, where electric energy is taken from the intermediate DC circuit. By means of the flow of energy in the connection of the additional motor to the intermediate DC circuit, the roller drive and in particular the function of the additional motor and thus the safety drive for the feed can easily be monitored. By means of the additional motor in the drive train of the feed roller it is comparatively easily possible to maintain the feed drive even in the case of a breakdown of the electric drive motor provided for this purpose, until a control intervention is performed due to the monitoring of the drive. The advantage of such safety drive can advantageously be utilized not only in needling machines, but wherever an interruption of an electric roller drive can lead to a damage of the web of material to be conveyed by means of the feed roller, as this is the case for instance with calander rollers, the heating of which may give rise to a thermal overload of the web of material when the feed is stopped.

In the case of an interruption of the drive due to a mains failure, an emergency power supply of the intermediate DC circuit may be provided in a manner known per se. Particularly advantageous conditions are obtained in this connection in needling machines with a main drive shaft driven by a main drive, when the intermediate DC circuit is connected to a generator driven by the main drive shaft. Even in the case of a mains failure during the slowing down of the needling machine, this generator will supply electric energy to the intermediate DC circuit, so that after a mains failure the energy supply of the drive motor for the feed roller is ensured for the process of slowing down. Since the generator driven by the main drive shaft will also supply electric energy to the intermediate DC circuit in the case of a mains operation, the function of the generator can be monitored via this supply of energy. To ensure the electric control of the needling machine in the case of a mains failure while the machine slows down, the control of the needling machine and the actuator for the clutch or clutches of the main drive can be provided with electric energy via the intermediate DC circuit.

BRIEF DESCRIPTION OF THE DRAWING

In the drawing, the subject-matter of the invention is represented by way of example, and there is shown an inventive roller drive for the web feed of a needling machine in a schematic block circuit diagram.

DESCRIPTION OF THE PREFERRED EMBODIMENTS

In accordance with the illustrated embodiment, the feed roller 1 for the web feed of a conventional needling machine, which is not represented in detail, is driven by an electric drive motor 2 via a transmission 3 and a chain drive 4. The drive motor 2, in the embodiment an asynchronous motor, is provided with electric energy by means of a converter circuit 6 via an intermediate DC circuit 5, which electric energy is supplied to the intermediate DC circuit 5 by an electric AC network 7, namely via a rectifier circuit 8. In the mechanical drive train between the drive motor 2 and the feed roller 1 there is incorporated an additional electric motor 9, likewise an asynchronous machine, which is driven via a clutch 10 by the drive motor 2. The additional motor 9 is connected to the intermediate DC circuit 5 via a converter circuit 11. In the case of a troublefree drive of the feed roller 1 via the drive motor 2, the additional motor 9 is operated as generator, which feeds electric energy into the intermediate DC circuit 5 via the converter circuit 11. By means of the converter circuit 11 the flow of energy in the connection 12 of the additional motor 9 can be monitored at the intermediate DC circuit 5, and thus the function of the additional motor 9 can be checked. Should the drive motor 2 break down for any reason, the additional motor 9 is no longer driven, so that no electric energy is fed into the intermediate DC circuit 5 via the additional motor 9. Electric energy is rather withdrawn from the intermediate DC circuit 5, because the additional motor 9 performs the drive for the feed roller 1. Since the rotational speed difference between the generator mode and the motor mode of the additional drive 9 can be kept comparatively small, the resulting reduction of the feed rate up to a corresponding control intervention hardly influences the needling result, all the more so as upon monitoring the roller drive by a pick-up 13 for the rotational speed of the drive motor 2, the breakdown of the same can immediately be reported to the machine control.

The provision of an additional motor 9 not only ensures a safety drive for the feed roller 1, but also provides for utilizing the correspondingly designed additional motor for a quick feed, when the needle bars are not driven, for instance during the feed of the web or similar processes. The drive motor 2 can thus be designed for a smaller range of rotational speeds, so that the additional effort caused by the additional motor 9 is at least partly compensated.

In order to maintain the feed drive while the needling machine slows down in the case of a mains failure, there is provided a generator 15, preferably likewise an asynchronous machine, which can be driven by the main drive shaft 14 of the needling machine and feeds the produced electric energy into the intermediate DC circuit 5 via a rectifier circuit 16. The energy supply of the drive motor 2 or the additional motor 9 for the feed roller 1 is thus also ensured in the case of a mains failure while the machine slows down. As even in the case of a mains operation the generator 15 supplies energy to the intermediate DC circuit 5, the proper function of the generator 15 can continuously be monitored via the rectifier circuit 16.

Via corresponding transducers 17 and 18, the control of the needling machine and the energy supply of the clutch or clutches for the main drive, while the needling machine slows down, can be ensured via the intermediate DC circuit 5, so that the needling machine can properly be shut off without a risk of damaging the web. The control of the needling machine determines the rotational speed for the drive motor 2 and the additional motor 9, respectively.

The invention is of course not restricted to the illustrated embodiment. Instead of the asynchronous machines there might for instance also be used DC machines. It is merely important that the additional motor 9 can also be operated as generator.

We claim:

1. A roller drive for the feed of a web of material, in particular for the web feed of a needling machine, comprising an electric drive motor for at least one feed roller, which is connected to a mains-operated intermediate DC circuit, characterized in that the mechanical drive train between the drive motor (2) and the feed roller (1) includes an additional electric motor (9) likewise connected to the intermediate DC circuit (5), which additional motor can be driven as generator by the drive motor (2).

2. The roller drive as claimed in claim 1 with a main drive for a main drive shaft of a needling machine, characterized in that the intermediate DC circuit (5) is connected to a generator (15) driven by the main drive shaft (14).

3. The roller drive as claimed in claim 2, characterized in that the control of the needling machine and the actuator for the clutch or clutches between the main drive and the main drive shaft (14) can be provided with electric energy via the intermediate DC circuit (5).

* * * * *